United States Patent [19]

Walsh

[11] Patent Number: 4,969,276

[45] Date of Patent: Nov. 13, 1990

[54] CLOTHES DRYER/FILTER/HUMIDIFIER

[75] Inventor: Robert Walsh, Kamloops, Canada

[73] Assignee: Aqua-Vent Products, Inc., Kanloops, Canada

[21] Appl. No.: 413,440

[22] Filed: Sep. 27, 1989

[51] Int. Cl.[5] ..... F26B 19/00

[52] U.S. Cl. ..... 34/90; 34/235; 34/82; 55/244

[58] Field of Search ..... 34/90, 91, 235, 86, 34/79, 82; 126/113; 55/244

[56] References Cited

U.S. PATENT DOCUMENTS

| | | | |
|---|---|---|---|
| 2,825,148 | 3/1958 | Olson | 34/82 |
| 3,999,304 | 12/1976 | Doty | 34/82 |
| 4,115,485 | 9/1978 | Genessi | 55/244 |
| 4,137,647 | 2/1979 | Clark, Jr. | 34/86 |
| 4,388,766 | 6/1983 | Sanderson | 34/86 |
| 4,395,831 | 8/1983 | Nielson | 34/235 |
| 4,434,564 | 3/1984 | Braggins, Jr. | 34/235 |
| 4,498,247 | 2/1985 | Benevento | 34/86 |

*Primary Examiner*—Henry A. Bennet
*Assistant Examiner*—Denise L. Ferensic
*Attorney, Agent, or Firm*—Wells, St. John & Roberts

[57] ABSTRACT

An air filter and humidifier is attached to the back of a clothes dryer. Exhaust air is ducted from the clothes dryer exhaust port to the inlet port on the bottom of the filter/humidifier. From there, the exhaust air is directed upwardly through the filter/humidifier. A deflector redirects the exhaust air obliquely downward against the surface of water within a container. The water humidifies and filters the exhaust air. A variable amount of the conditioned air escapes through an adjustable vent lid into the home and the remainder is discharged through the filter/humidifier and ducted outdoors. A hinged or removable lid allows the user to remove the water container to add or replace water.

9 Claims, 3 Drawing Sheets

CLOTHES DRYER/FILTER/HUMIDIFIER

TECHNICAL FIELD

This invention relates to a filter/humidifier for connection to the air exhaust of a clothes dryer.

BACKGROUND OF THE INVENTION

The standard clothes dryer is a common device within the home in which a great deal of energy is wasted when its warm exhaust is vented outside the home. The current concern for more efficient use of energy has prompted various inventions relating to energy conservation.

It would be desirable, in light of the high cost of energy, to utilize the heat exhausted by the dryer to warm the home during cold weather. However, most filters used in the exhaust of clothes dryers are designed only to remove large particles. Since small particles and dust are not filtered, the air is not suitable for discharge into the home. Therefore, an exhaust duct is typically connected to the dryer's exhaust port to conduct the air exhaust outside the home.

The addition of conventional filtering to the dryer exhaust system results in unacceptable back-pressure while failing to satisfactorily remove dust particles from the exhaust air. Further, even if such a filter were acceptable, it is desirable to discharge the hot exhaust air into the home only in the colder winter months. Accordingly, it would be necessary to change the exhaust ducting from in-home exhaust to outside exhaust when approaching summer and back to in-home exhaust when again nearing winter.

This invention provides an improvement over previous clothes dryer exhaust filtering systems by providing more effective filtering, greater convenience, and easy adjustment of the amount of conditioned are entering the home. Additionally, it humidifies the clothes dryer exhaust air. Humidification is desirable since winter air and conventional home heating systems often produce a very dry atmosphere within the home during the winter months.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
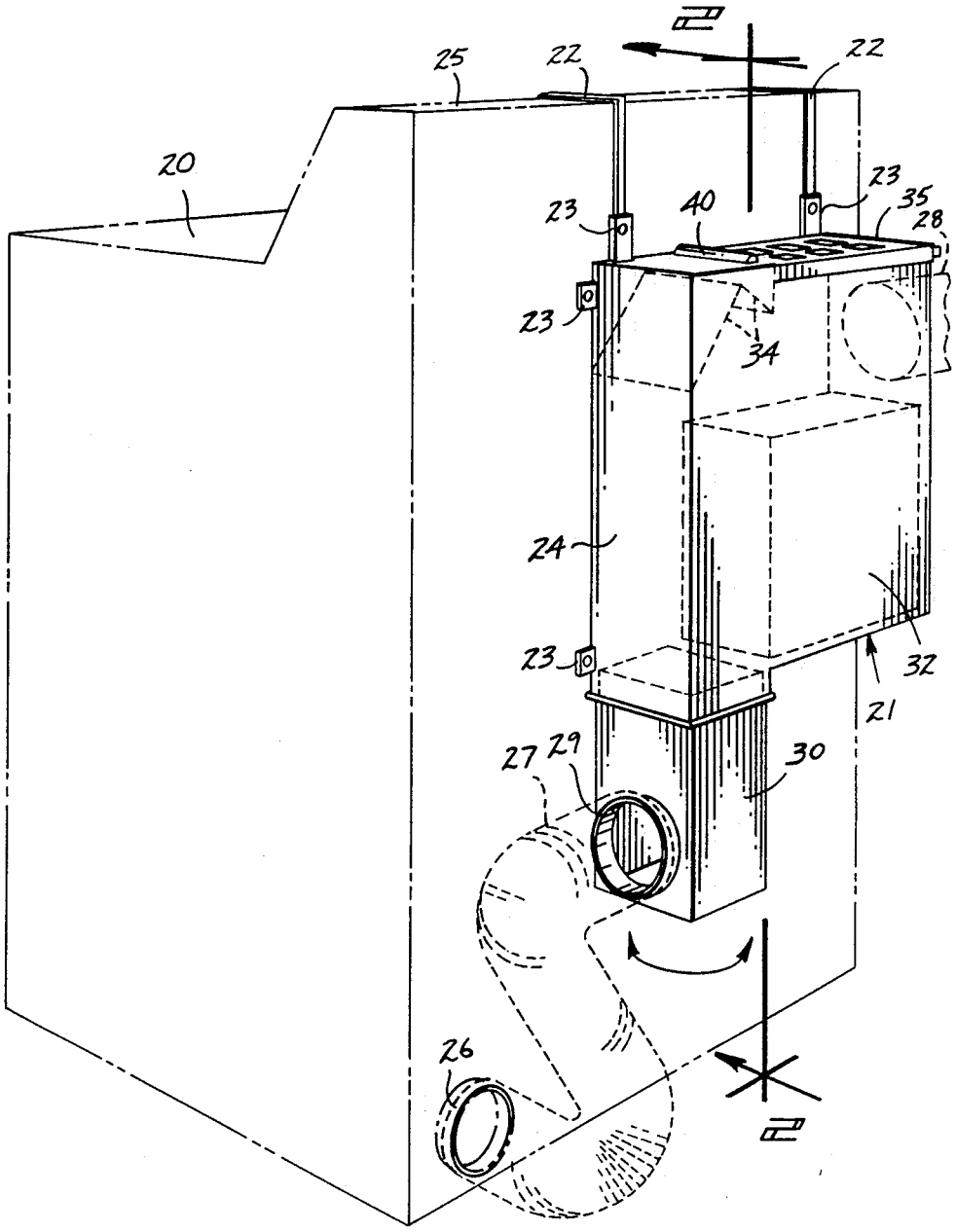
FIG. 1 is an isometric view of the rear of a clothes dryer with the filter/humidifier attached.

The preferred embodiment of the invention is shown in FIGS. 1, 2, 3, and 4. In FIG. 1, a filter humidifier 21 is shown attached to the rear of a clothes dryer 20. Mounting straps 22 are bolted to mounting tabs 23 of enclosure 24. The straps 22 hook over the control panel 25 of the clothes dryer 20. The filter/humidifier 21 can also be bolted directly to the back of the dryer or attached to a nearby wall using mounting tabs 23. To prevent scratching the dryer, the straps 22 can be rubber or plastic coated.

An upstream exhaust duct 27 connects the dryer exhaust port 26 to the filter/humidifier inlet port 29.

Figure 2:
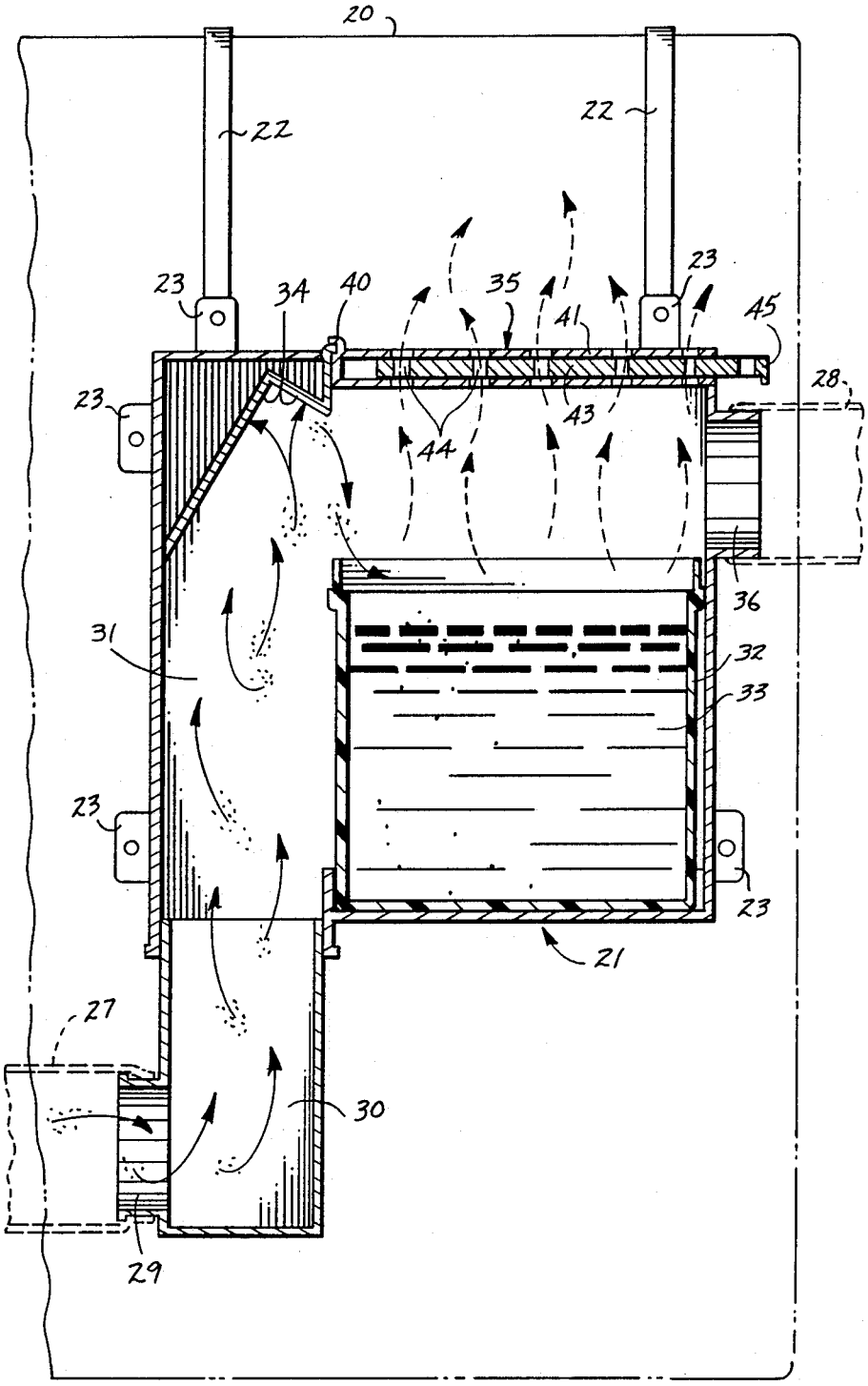
FIG. 2 is a rear cut-away view showing the air flow through the filter/humidifier.

Referring now primarily to FIG. 2, the enclosure 24 contains an open water container 32 which is partially filled with water 33. A rope handle (not shown) may be provided at the top of container 32 to aid in its removal.

A hollow adapter 30 is attached to the bottom of enclosure 24. The adapter 30 receives the air exhaust from upstream exhaust duct 27 and routes the air upward to the lower end of an inlet duct 31 within enclosure 24. Adapter 30 may be attached so that its inlet port 29 extends to either side or to the rear of the dryer/filter/humidifier combination.

The inlet duct 31, essentially a hollow space between the water container 32 and one upright side wall of enclosure 24, routes the dryer exhaust air upwardly until it hits deflector 34. The deflector 34 is comprised of a pair of flat surfaces which routes the air obliquely downward and toward the surface of the water 33.

As the exhaust air hits the surface of the water 33, any dust or lint is trapped in the water 33. Since the air is warm, the water will also tend to evaporate, thereby humidifying the exhaust air. The filtered and humidified exhaust air escapes the enclosure 24 through either the vent lid 35 or through a downstream exhaust duct 28 which is connected to the filter humidifier exhaust port 36.

Figure 3:
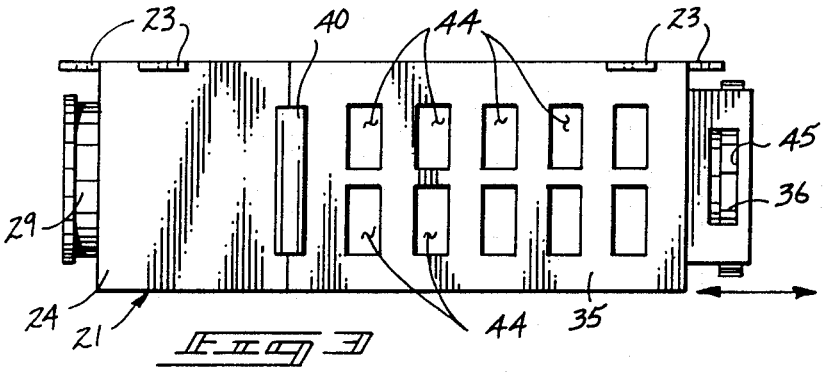
FIG. 3 is a top view showing the vent lid.
Figure 4:
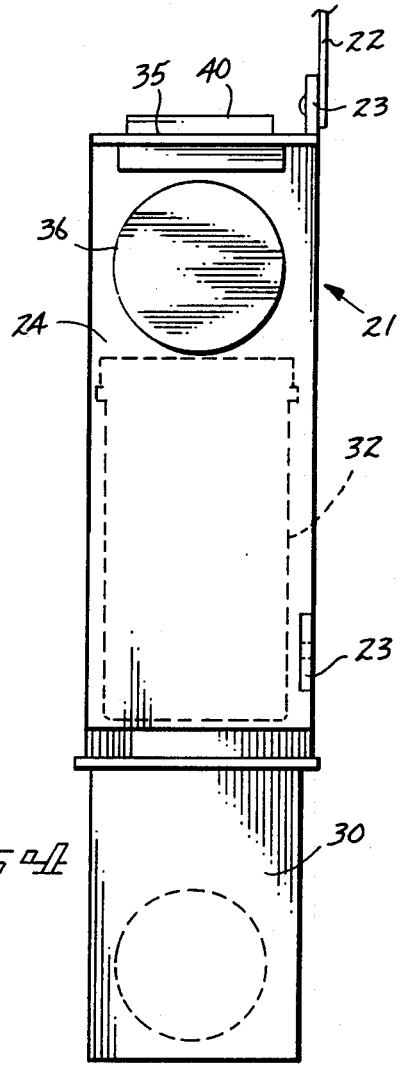
FIG. 4 is a side elevational view seen from the right in FIG. 2.

Referring now particularly to FIGS. 2 and 3, the vent lid 35 allows a variable amount of conditioned air into the home and, when hinged to an opened condition, allows removal of water container 32. The vent lid 35 is attached to the enclosure by a hinge 40. When closed, the vent lid 35 provides an essentially air tight seal on the enclosure.

The vent lid 35 comprises an adjustment plate 43 which slides between outer plates 41 to allow adjustment of the air flow. Each plate 41 and 43 has apertures 44 which, when the adjustment plate 43 is at its fully open position, align with one another and correspond to allow air flow through the vent lid 35. At its fully closed position, the apertures 44 in the adjustment plate 43 are offset from the apertures 44 in the outer plates 41. Thus, all air flow through the lid is blocked. The adjustment plate 43 can be placed at any intermediate position to provide partial correspondence between the apertures, allowing partial air flow. Adjustment plate 43 may be adjusted manually using the handle 45.

Any air which does not discharge through the vent lid 35 escapes through the filter/humidifier exhaust port 36 and the downstream exhaust duct 28.

In compliance with statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An air filter and humidifier adapted to be connected between the upstream and downstream exhaust ducts of a clothes dryer for conditioning its air exhaust comprising:

(a) an enclosure;

(b) a water container having an open upper end within the enclosure;

(c) routing means within the enclosure for receiving the air exhaust of a clothes dryer and directing it obliquely toward the open upper end of the water container; and (d) outlet means within the enclosure for discharging the air exhaust directly into a room containing the enclosure.

2. The air filter and humidifier of claim 1, further comprising:

(a) means for mounting the device to the clothes dryer.

3. The air filter and humidifier of claim 1, wherein the outlet means further comprises:

(a) a fitting adapted to be connected to the downstream exhaust duct of a clothes dryer; and (b) adjustable vent means for variably discharging a portion of the conditioned air directly into the atmosphere of a room containing the enclosure.

4. An air filter and humidifier adapted to be connected between the upstream and downstream exhaust ducts of a clothes dryer for conditioning its air exhaust comprising:

(a) an enclosure having a partially open top end and a closed lower end;

(b) a water container having an open upper end within the enclosure, the water container being removable from the enclosure through the partially open top end;

(c) inlet means in the enclosure adapted to receive the air exhausted at the upstream exhaust duct of a clothes dryer;

(d) inlet duct means extending vertically within the enclosure adjacent to the container, the inlet duct means having a lower end communicating with the inlet means;

(e) deflector means within the enclosure at a location above the upper end of the inlet duct for directing air toward the open upper end of the water container;

(f) fitting means in the enclosure for connection to the downstream exhaust duct of a clothes dryer; and (g) a lid covering the partially open top side of the enclosure, the lid including vent means for discharging the conditioned air into the atmosphere of a room containing the enclosure.

5. The air filter and humidifier of claim 4, wherein the lid is removable to allow removal of the container from within the enclosure.

6. The air filter and humidifier of claim 4, wherein the lid is hinged to allow removal of the container from within the enclosure.

7. The air filter and humidifier of claim 4, wherein the vent means is adjustable to vary the amount of air exhaust discharged into the atmosphere through it.

8. The air filter and humidifier of claim 4 wherein the vent means comprises:

(a) first and second plates, each having at least one aperture, the first and second plates being aligned so that at least one aperture of the first plate and at least one aperture of the second plate form at least one pair of coinciding apertures; and (b) an adjustment plate slidably fitting between the first and second plates between a fully closed position and a fully open position, the adjustment plate having at least one aperture positioned to coincide with at least one pair of coinciding apertures in the first and second plates only when the adjustment plate is at its fully open position, whereby discharge of the air exhaust into the atmosphere through the coinciding apertures is permitted when the adjustable plate is in its fully open position and discharge of the air exhaust into the atmosphere is prevented when the adjustable plate is in its fully closed position.

9. The air filter and humidifier of claim 4, wherein:

(a) the inlet means further comprises a hollow adapter mounted to the lower end of the enclosure and adapted on one side to be connected to the upstream exhaust duct of a clothes dryer;

(b) the adapter having an open upper end communicating with the lower end of the inlet duct to provide communication between the upstream exhaust duct and the lower end of the inlet duct; and (c) the adapter being mountable to the enclosure in at least two orientations, whereby the upstream exhaust is receivable from at least two horizontal directions.

* * * * *